United States Patent [19]

Wang et al.

[11] Patent Number: 4,923,159

[45] Date of Patent: May 8, 1990

[54] HOOK SEAT WITH A SEPARABLE HOOK

[76] Inventors: Hsug-Fang Wang, No. 129, Tuan-chu Lane, Tuan-chu Li, Chiayi; Take Wu, No. 53-47, Shih-ti, Shin-Tsun Li, Chiayi, both of Taiwan

[21] Appl. No.: 288,095

[22] Filed: Dec. 22, 1988

[51] Int. Cl.[5] ..... A47G 1/16

[52] U.S. Cl. ..... 248/205.3; 248/544; 248/223.4

[58] Field of Search ..... 248/205.3, 544, 497, 248/225.2, 224.3, 223.4

[56] References Cited

U.S. PATENT DOCUMENTS

| | | | |
|---|---|---|---|
| 2,432,719 | 12/1947 | Braun | 248/544 |
| 2,451,194 | 10/1948 | Braun | 248/544 |
| 3,532,316 | 10/1970 | Mathes | 248/205.3 |
| 3,848,843 | 11/1974 | Levy | 248/223.4 |
| 4,446,642 | 5/1984 | Chap | 248/223.4 X |

FOREIGN PATENT DOCUMENTS

| | | | |
|---|---|---|---|
| 1016563 | 1/1966 | United Kingdom | 248/223.4 |

*Primary Examiner*—Ramon S. Britts
*Assistant Examiner*—Karen J. Chotkowski
*Attorney, Agent, or Firm*—Harness, Dickey & Pierce

[57] ABSTRACT

The present invention relates to a hook seat comprising a seat body having a front side, a rear side and a channel between the front side and the rear side, the rear side including a peripheral portion and a recess defined by the peripheral portion; the channel possibly having an enlarged mouth at the front side. In addition, the front side may have a peripheral flange for engaging with a hook cover and a depressed portion surrounded by the peripheral flange, causing the mouth to be extruded from the depressed portion and be flush with the peripheral flange.

2 Claims, 4 Drawing Sheets

HOOK SEAT WITH A SEPARABLE HOOK

BACKGROUND OF THE INVENTION

The present invention relates to a hook seat, and more specifically to a hook seat coupled with a hook cover, which can be conveniently stick to a support.

As is well known, hooks are universally used devices for hanging day-to-day articles. In the prior art, there is a kind of self-adhesive hooks which comprises a layer of adhesive material covered with a paper film on its rear side; when applied, the paper film is removed, and the layer of adhesive material is attached to a support, sticking the hook onto the support. But this kind of hook can only hang articles of little weight, and may not be applied on all surfaces. In other words, a damp or an unclean support surface will weaken the layer of adhesive material, resulting in the separation of the hook from the support surface.

There is another kind of hook which generally comprises a hook cover A and a hook seat B, as shown in FIG. 1; the hook cover A includes a hook finger A1 and a circumferential groove A2; the hook seat B has a peripheral flange B1 for engaging with the circumferential groove A2 of the hook cover A, a depressed portion B2 surrounded by the peripheral flange B1 at its front side, and a thin layer of adhesive material B3 on its rear side for sticking to a support. The cross-sectional side view of the hook seat B is shown in FIG. 2. For the application of the hook, refer to FIG. 3. The layer of adhesive material B3 is ordinarily composed of a cold setting adhesive and must be melted by a heating device C in order to be effective. As shown in FIG. 3, the heating device C is merely designed for the use of heating the hook seat B, and it has a handle C1 and a heating body C2; the heating body C2 comprises a recess C4 at its top end C3 and a heating base C5 which is protruded from the recess C4 and flush with the top end C3. While installing the hook, the heating base C5 is inserted into the depressed portion B2, causing the peripheral flange B1 to be enclosed in the recess C4. After the power is turned on, electric heat will be transmitted from the heating base C5 through the depressed portion B2 to the layer of adhesive material B3, resulting in the melting of said adhesive material, so that the whole hook seat B can be firmly attached to a support. Finally, the circumferential groove A2 is mounted on the peripheral flange B1, and the overall installation of the hook is completed. The main shortcoming of this kind of hook is that a customer must buy a heating device C, otherwise he/she will not be able to apply this kind of hook. This heating device C is also very impractical and uneconomical since it may only be used for the heating of the layer of adhehesive material on the aforementioned hook seats. Another shortcoming is revealed by the fact that, because the rear side of the hook seat is a smooth surface, if the surface of a support or the melting of the layer of adhesive material is uneven, an unstable attachment of the hook to the support will happen.

Accordingly, it is an objective of the present invention to provide a hook seat which can be firmly attached to a support.

Another objective of the present invention is to provide a separable hook which comprises a hook cover and a hook seat, the latter permitting the hook to be firmly mounted on a support.

SUMMARY OF THE INVENTION

The present invention provides a hook seat which has a better adhesive strength and can be applied with a common household tool.

The present hook seat comprises a seat body which has a front side, a rear side and means for communicating the front side with the rear side; the rear side includes a peripheral portion and a recess defined by the peripheral portion. Whereby, when the seat body is attached to a support, a flowable adhesive can be introduced from the front side, through the communicating means, into the recess to fill a chamber which is defined by the peripheral portion, the recess and the support.

The present invention further provides a separable hook which comprises a hook cover and a hook seat including a seat body as mentioned above. In addition, the front side of the seat body has a peripheral flange, and the hook cover has a hook finger and a circumferential groove to engage with the peripheral flange of the hook seat. The front side of the hook seat may further include a depressed portion surrounded by the peripheral flange, causing the mouth of the communicating means at the front side to be protruded therefrom and be flush with the peripheral flange.

In the present invention, the mouth of the communicating means at the front side may be larger than that at the rear side so as to facilitate the introduction of the flowable adhesive.

The present invention will be well understood by a detailed description of a preferred embodiment with reference to the accompanying drawings, in which:

DETAILED DESCRIPTION OF THE INVENTION

Figure 1:
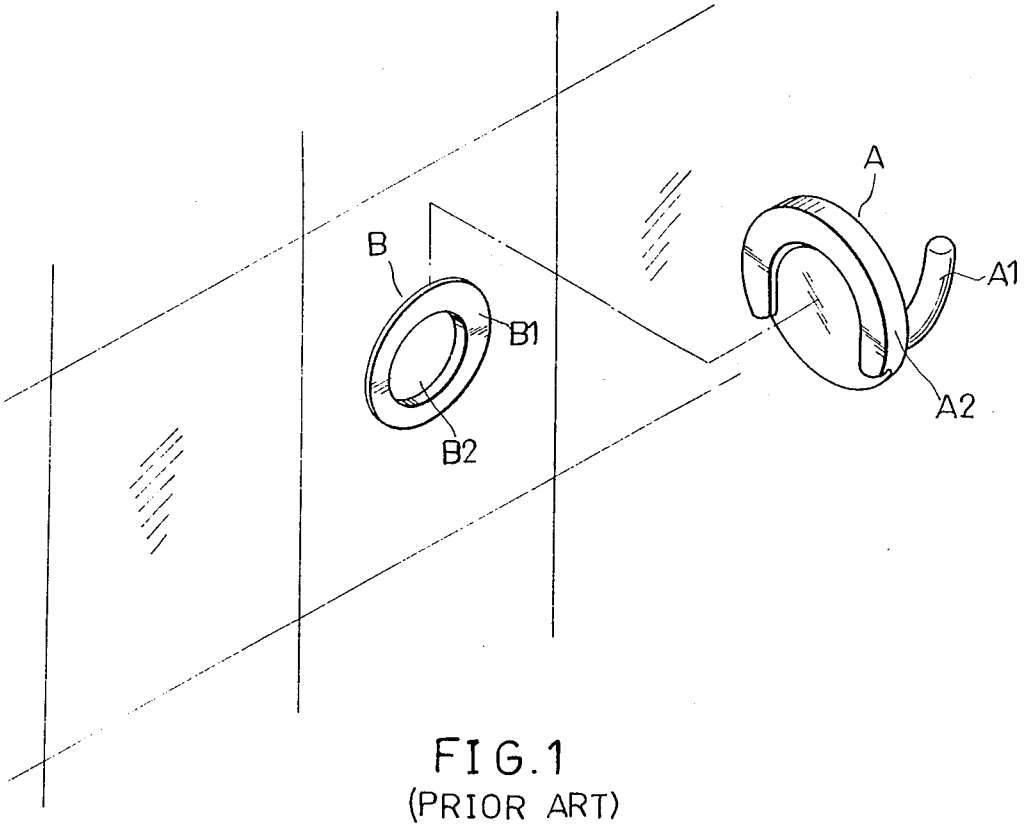
FIG. 1 (PRIOR ART)
FIG. 1 is an exploded view of a hook according to the prior art.
Figure 4:
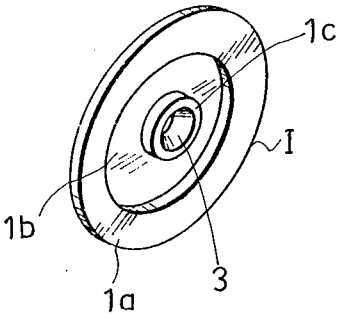
FIG. 4 shows a perspective view of an preferred embodiment of the present invention.
Figure 2:
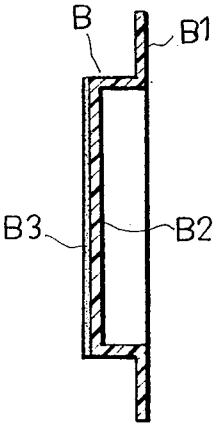
FIG. 2 (PRIOR ART)
FIG. 2 is a cross-sectional side view of the hook seat shown in FIG. 1.
Figure 3:
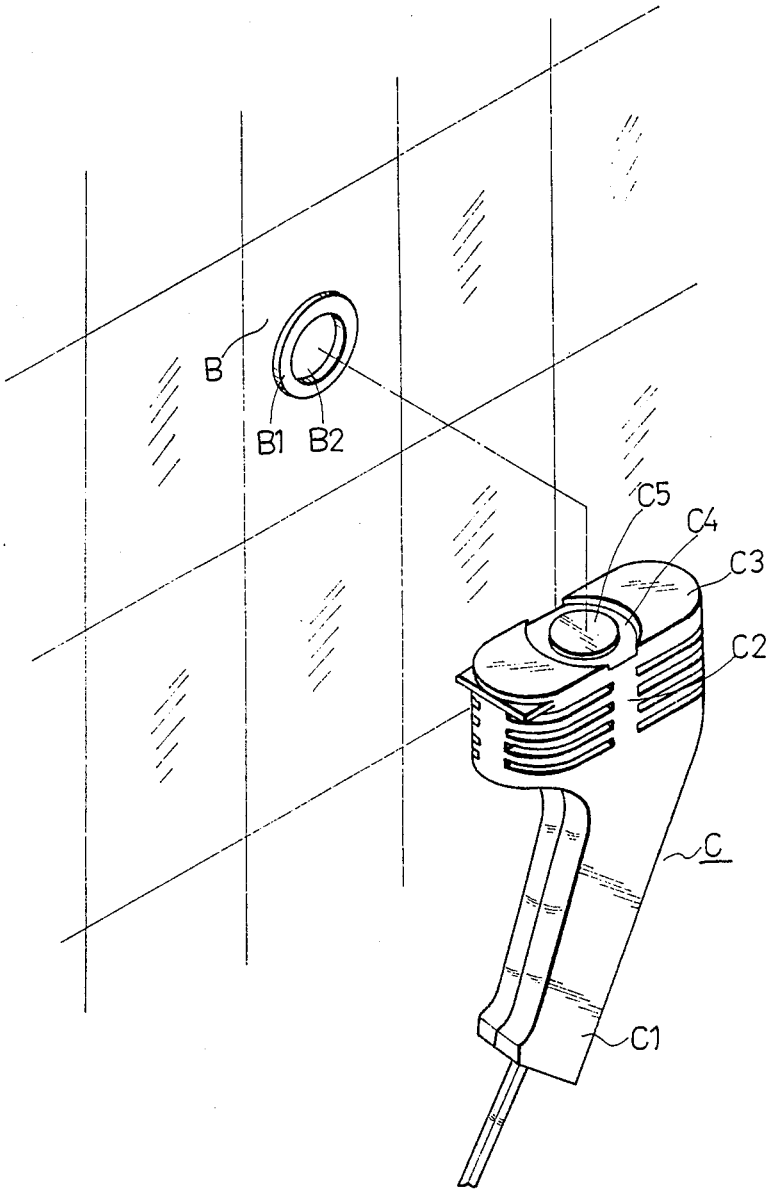
FIG.3 (PRIOR ART)
FIG. 3 illustrates a heating device C associated with the hook B.
Figure 5:
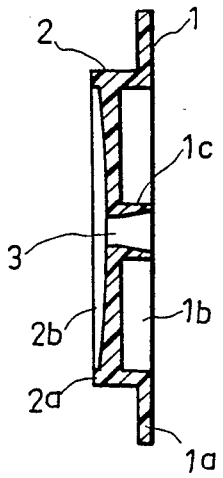
FIG. 5 shows a cross-sectional side view of the preferred embodiment of the present invention.
Figure 6:
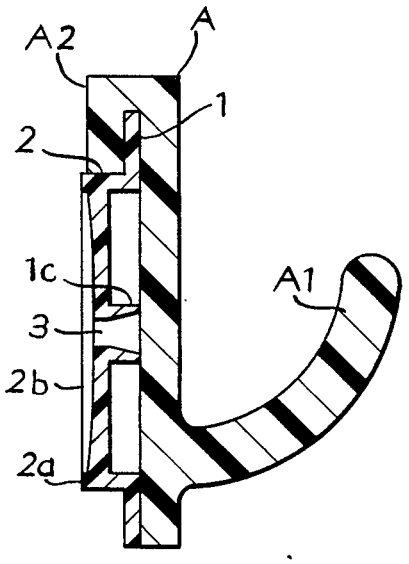
FIG. 6 is a cross-sectional view of the preferred embodiment of FIG. 5 having a hook cover of the type illustrated in FIG. 1 shown in assembled relationship thereto, the hook cover also being shown in cross-section.

FIGS. 4 and 5 respectively represents a perspective view and a cross-sectional side view of a preferred enbodiment of the present invention, which is a hook seat comprising a seat body. As shown in FIG. 5, the seat body has a front side 1, a rear side 2 and a communicating means 3 between front side 1 and rear side 2. On front side 1, is a peripheral flange 1*a*, a depressed portion 1*b* surrounded by peripheral flange 1*a*, and a mouth 1*c* of the communicating means at front side 1, which is extruded from depressed portion lb and flush with peripheral flange 1*a*; at rear side 2, there is a peripheral portion 2*a*, and a recess 2*b* defined by peripheral portion 2*a*. Whereby, when the hook seat is attached to a support, peripheral portion 2*a*, recess 2*b* and the support will define a chamber which is accessible from the outside of the support via communicating means 3. To apply the hook seat, the user should attach rear side 2 to a surface of a support and introduce a flowable adhesive from mouth 1*c* at front side 1 through communicating means 3 into the chamber, thereby the adhesive will fix the hook seat onto the support, and the hook seat will be ready to engage with a hook cover.

Mouth 1*c* may be enlarged to facilitate the introduction of a flowable adhesive, and the adhesive can be injected into the chamber by a generally used family tool(i.e., a glue gun). The application of the hook seat will not be limited by the environment and the hook seat has an adhesive capability better than that of the prior art.

As will be appreciated by those skilled in the art, the present invention overcomes the defects of the prior art, and the preferred embodiment of the present invention described above will not restrict the scope and the spirit of the present invention.

What is claimed is:

1. A hook for hanging an article comprising a hook seat, said hook seat including a seat body having a front side including a peripheral flange and a rear side, said rear side including a peripheral portion which defines a recess, thereby when said seat body is attached to a support, said peripheral portion, said recess and said support define a chamber, means for communicating said recess with said front side, said communicating means having an enlarged mouth at said front side, thereby a flowable adhesive can be introduced from said front side into said recess so as to fill said chamber, said front side having a depressed portion surrounded by said peripheral flange and said enlarged mouth is flush with said peripheral flange, and a hook cover including a hook finger mounted on said front side for hanging an article, said hook cover having a circumferential groove to engage with said peripheral flange.

2. A hook for hanging an article comprising a hook seat, said hook seat including a seat body having a front side including a peripheral flange and a rear side, said rear side including a peripheral portion which defines a recess, thereby when said seat body is attached to a support, said peripheral portion, said recess and said support define a chamber, means for communicating said recess with said front side, said communicating means having an enlarged mouth at said front side, thereby a flowable adhesive can be introduced from said front side into said recess so as to fill said chamber, said front side having a depressed portion surrounded by said peripheral flange and said enlarged mouth is flush with said peripheral flange.

* * * * *